United States Patent [19]

Alshuk

[11] 4,125,004

[45] Nov. 14, 1978

[54] ROLLING MILL GAUGE CONTROL SYSTEM

[75] Inventor: Thomas J. Alshuk, Wethersfield, Conn.

[73] Assignee: Amtel, Inc., Providence, R.I.

[21] Appl. No.: 814,932

[22] Filed: Jul. 12, 1977

[51] Int. Cl.[2] ..... B21B 37/00

[52] U.S. Cl. ..... 72/9; 72/16

[58] Field of Search ..... 72/6–10, 72/16

[56] References Cited

U.S. PATENT DOCUMENTS

| | | | |
|---|---|---|---|
| 3,186,201 | 6/1965 | Ludbrook et al. | 72/9 |
| 3,561,237 | 2/1971 | Eggers et al. | 72/7 |
| 3,568,637 | 3/1971 | Smith, Jr. | 72/8 |
| 3,631,697 | 1/1972 | Deramo et al. | 72/8 |
| 3,694,636 | 9/1972 | Smith, Jr. | 72/8 |

*Primary Examiner*—Milton S. Mehr

*Attorney, Agent, or Firm*—Prutzman, Kalb, Chilton & Alix

[57] ABSTRACT

An automatic feed backward gauge control system for screwdown adjustment of a cold rolling mill using a mill screwdown model employing measured output gauge and simulated input gauge variables and adaptive by modification of the simulated input gauge to reflect output gauge offset and drift errors in accordance with statistical analysis of sample comparisons of expected and measured output gauge.

14 Claims, 3 Drawing Figures

11
TRANSDUCER
40
12
14
18
SERVO VALVE
EX.
M
TACH.
34
GAUGE LOGIC
20
STRIP LENGTH LOGIC
35
DIAGNOSTIC LOGIC
46
PROGRAMMED DIGITAL COMPUTER
26
FIXED & TRANSIENT DATA STORAGE
22
INCREMENTAL SCREWDOWN ADJUSTMENT CONTROL
31
30
SCREWDOWN INPUT LOGIC
32
CARD DATA INPUT TERMINAL
36
MANUAL DATA INPUT TERMINAL
37
MILL OPERATING CONTROLS
44
MANUAL SCREWDOWN CONTROL
42
MILL CONTROL DESK

ROLLING MILL GAUGE CONTROL SYSTEM

SUMMARY OF THE INVENTION

The present invention relates generally to rolling mill gauge control systems and more particularly to a new and improved adaptive gauge control system having notable utility in the automatic gauge control of a cold rolling mill having, for example, a Sendzimir type reversing mill stand.

It is a principal aim of the present invention to provide a new and improved mill screwdown model for a feed backward adaptive gauge control.

It is another aim of the present invention to provide a new and improved adaptive gauge control system requiring only workpiece travel and output gauge measurements and employing a new and improved method of determining corrective mill screwdown adjustment and adaptively controlling the system to reflect any long-term workpiece output gauge offset and drift errors.

It is a further aim of the present invention to provide a new and improved method of determining corrective mill screwdown adjustment using output gauge measurement and a calculated or simulated input gauge and adapting the mill screwdown adjustment method through modification of the calculated input gauge. In accordance with the present invention, the calculated or simulated input gauge is adaptively controlled to reflect the numerous measurable and theoretical rolling mill parameters affecting the workpiece output gauge, and whereby the adaptive control system provides relatively simplified automatic adaptive control reflecting offset and drift errors.

It is another aim of the present invention to provide in an automatic gauge control system, a new and improved method for determining screwdown adjustment and of providing adaptive control without requiring roll separating force measurement.

It is a further aim of the present invention to provide in an automatic gauge control system, a new and improved method of determining screwdown adjustment employing measured output gauge and a calculated input gauge adaptively controlled to simulate measurable and theoretical mill parameters affecting the workpiece output gauge.

It is another aim of the present invention to provide a new and improved relatively low cost automatic gauge control system which provides accurate, adaptive gauge control. In accordance with the preferred embodiment of the present invention, workpiece travel and output gauge measurements are the only mill stand measurements used in the automatic gauge computation process, thereby substantially reducing the cost of the gauge control system and yet without diminishing its accuracy and effectiveness.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
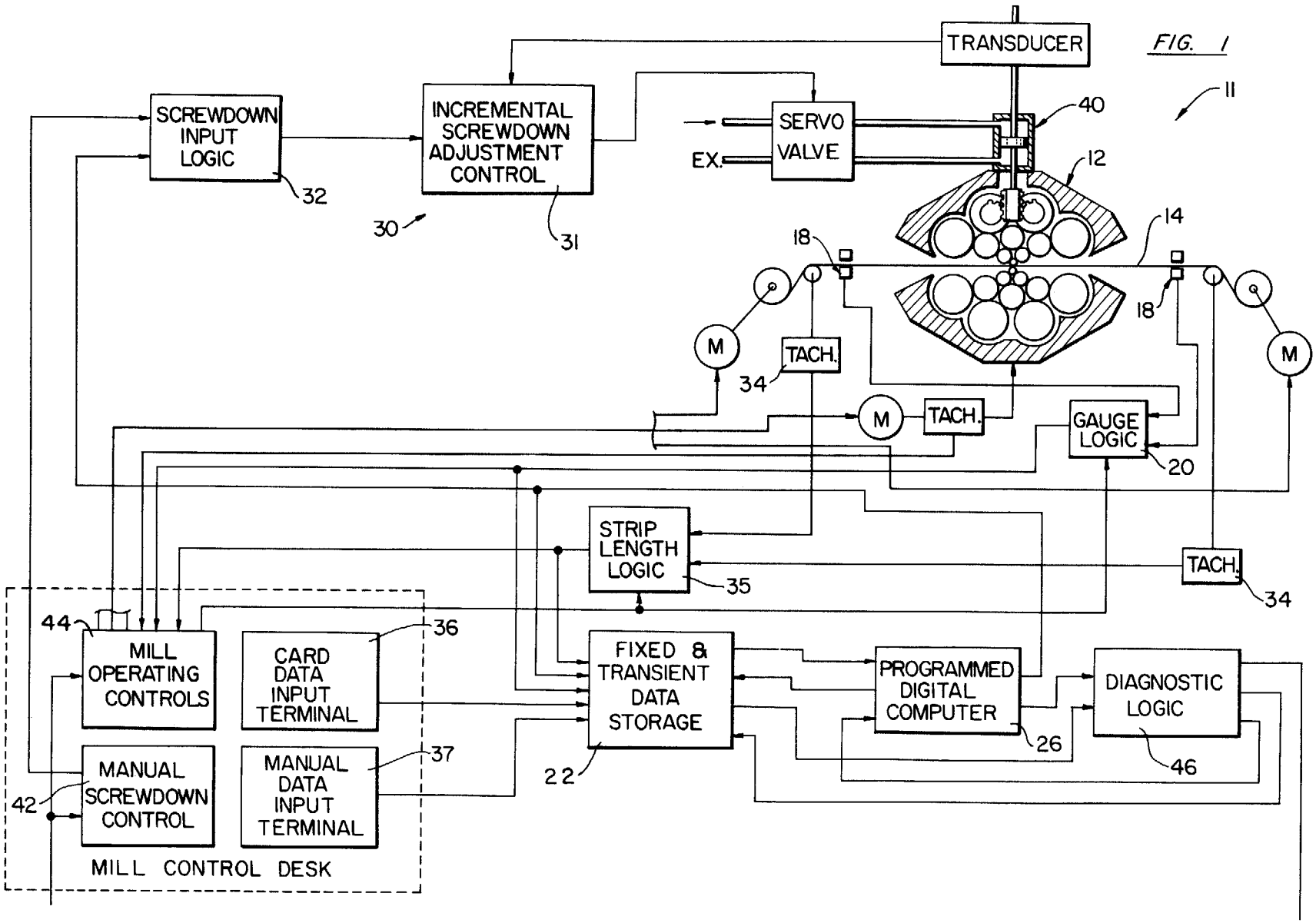
FIG. 1 is a combined schematic and diagrammatic view, partly broken away and partly in section, of a cold rolling mill incorporating an embodiment of a gauge control system of the present invention.

Referring now to the drawings in detail, an embodiment of an automatic gauge control system of the present invention is shown employed in a single stand cold roll reversing mill 11 having a 1-2-3-4 Sendzimir type mill stand 12, for controlling the output gauge or thickness of an elongated metal strip 14 passing between the two opposed inner or work rolls of the mill stand 12. Although the automatic gauge control system employs only feed backward gauge control, a suitable thickness gauge 18 is provided on each side of the mill stand 12 for use as an output thickness gauge when the reversing mill 11 is operated in the respective direction. The active gauge 18 is connected via a gauge logic circuit 20 to a suitable data memory or storage circuit 22 for subsequent use in operations performed by a programmed digital computer 26 as hereinafter described.

A suitable screwdown system 30 (for example, a screwdown system with a screwdown adjustment loop like that disclosed in U.S. Pat. No. 3,974,672, of John F. Herbst, entitled "Mill Hydraulic Screw-Down" and dated Aug. 17, 1976) is employed for adjusting the screwdown position and therefore the roll gap opening of the mill stand 12 for adjusting the output gauge or thickness of the rolled metal strip 14. An incremental screwdown adjustment control logic circuit 31 of the screwdown operating system 30 is connected via a suitable screwdown input logic circuit 32 to the digital computer 26 for automatic computer control of the output or thickness of the rolled metal strip as hereinafter described.

Also, suitable tachometers 34 (providing either workpiece speed signals or a workpiece length pulse for each predetermined length of rolled metal strip 14) are provided on opposite sides of the mill stand (for the opposite directions of operation of the reversing mill) for use in determining the output travel of the rolled metal strip. The active tachometer 34 is connected via a suitable strip length logic circuit 35 to the data storage circuit 22 for subsequent use in operations performed by the digital computer 26 as hereinafter described.

Additional predetermined data is transmitted via suitable data input terminals for storage in the data storage circuit 22 for subsequent use in operations performed by the digital computer 26 as hereinafter described. For example, a suitable magnetic or punched card reader 36 useful with suitable magnetic or punched cards (for example, with a pass card provided for each rolling mill pass or a predetermined multiple pass rolling sequence) and/or a suitable manually operable terminal 37 may be used for entering the required data, hereinafter described, into storage for subsequent use in operations performed by the digital computer. Such additional predetermined data includes the (a) nominal input or entrance gauge of the strip (hereinafter designated $G_{NI}$) for each rolling mill pass; (b) desired, preset or nominal output gauge of the metal strip (hereinafter designated $G_{NO}$) for each pass; and (c) mill spring constant (hereinafter designated $K_{Mill}$) of the mill stand 12. Also, if desired, the unloaded roll opening (hereinafter designated $R_O$) at the beginning of a multiple pass rolling sequence can be entered into storage, in which case the unloaded roll opening ($R_O$) is initially determined by the mill operator and entered into storage and is thereafter automatically updated by the computer 26 each time the screwdown position is incrementally adjusted by the gauge control system as hereinafter described. Preferably, prior to initiating each rolling mill pass, the mill operator (or, if desired, the automatic gauge control system if the existing unloaded roll opening ($R_O$) is provided in the data storage circuit ) will adjust the mill stand screwdown to set the unloaded roll opening ($R_O$) to a predetermined or calculated roll opening in accordance with the nominal input gauge or thickness ($G_{NI}$) of the metal strip workpiece and the desired or nominal output gauge or thickness ($G_{NO}$).

In general, the loaded roll opening of the mill stand 12 is considered to equal the actual output or delivery gauge or thickness of the rolled metal strip workpiece (hereinafter designated $G_O$) under the usually justifiable assumption there is little or no elastic recovery of the metal strip workpiece after it passes beyond the exit gauge 18. Also, as is well known, in accordance with Hooke's law, the loaded roll opening under workpiece rolling conditions equals the unloaded roll opening ($R_O$) plus the mill stand stretch caused by the separating force (hereinafter designated F) between the inner work rolls of the mill stand 12 and which is equal and opposite to the rolling force on the metal strip workpiece.

Thus:

$$G_O = R_O + F/K_{Mill} \quad (1)$$

Where:

$G_O$ = loaded roll opening or output gauge
$R_O$ = unloaded roll opening
$F$ = roll separating force
$K_{Mill}$ = mill spring constant In the gauge control system of the present invention, the roll separating force (F) is not measured and instead, a material deformation coefficient of the metal strip workpiece in process (hereinafter designated $C_{MD}$, and which is a coefficient of the rolling force required for reducing the gauge of the workpiece a predetermined amount) is determined from the ratio of output thickness or gauge ($G_O$) to a calculated or simulated strip input thickness or gauge (hereinafter designated $G_{CI}$) using a mathematical model or data bank stored in the data storage circuit 22. The mathematical model or data bank which is used is actually based on the ratio of actual output and input thicknesses or gauges (i.e., $C_{MD} = f(G_O/G_I)$ but in the gauge control system of the present invention a calculated or simulated input gauge or thickness ($G_{CI}$) is employed in place of actual measurement of the input gauge or thickness (hereinafter designated $G_I$) to eliminate the need for both input and output gauge readings during rolling mill operation and thereby simplify the gauge control system without reducing its reliability and effectiveness.

Figure 2:
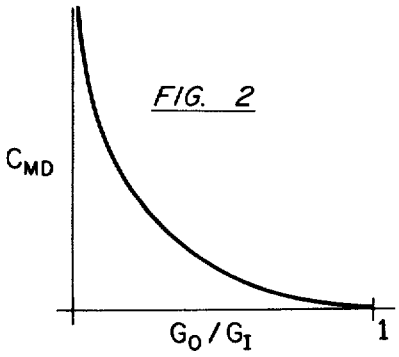
FIG. 2 is an exemplary graph of the relationship of a workpiece material deformation coefficient ($C_{MD}$) to the ratio of workpiece output and input gauges ($G_O/G_I$), and which relationship is employed in the screwdown adjustment model of the automatic gauge control system.

The mathematical model or data bank of the relationship of the workpiece material deformation coefficient ($C_{MD}$) to the ratio of output and input gauges or thickness ($G_O/G_I$) is suitably provided, for example, by rolling pass card inserted into the card reader 36. A graph is shown in FIG. 2 illustrating the relationship of $C_{MD}$ to $G_O/G_I$, it being seen that $C_{MD}$ is "0" when the gauge ratio $G_O/G_I$ is "1" (i.e., there is no gauge reduction in the metal strip) and $C_{MD}$ increases exponentially as the gauge ratio $G_O/G_I$ decreases (i.e., as the percentage gauge reduction of the workpiece increases). Also it can be seen that the non-linear curve relationship becomes asymtotic to the X axis as the gauge ratio $G_O/G_I$ approaches "0" (i.e., $G_O/G_I = 0$ being an unattainable condition).

As previously indicated, the material deformation coefficient ($C_{MD}$) is used instead of roll separating force (F) in the automatic gauge control system. In that regard, the roll separating force (F) is assumed to be directly proportional to the material deformation coefficient ($C_{MD}$) in accordance with the following equation:

$$F = C_{MD} \cdot A \quad (2)$$

Where:

$F$ = roll separating force.
$C_{MD}$ = the workpiece material deformation coefficient required for reducing the workpiece thickness from $G_I$ to $G_O$.
$A$ = effective rolling area. (The effective rolling area (A) is a function of the strip width and mill stand work roll diameter and can be separately inserted into the data storage circuit 22 for example via a pass card inserted into the card reader 36. Alternatively the relationship of the product $C_{MD} \cdot A$ to the gauge ratio ($G_O/G_I$) can be inserted directly into the data storage circuit 22.

The unloaded roll opening $R_O$ can therefore be determined by combining equations (1) and (2) as follows:

$$R_O = G_O - f(G_O/G_I) \cdot A/K_{Mill} \quad (3)$$

Thus, the actual screwdown position can be determined in accordance with the equation:

$$SD = R_O \cdot DR_S \cdot M \quad (4)$$

Where:

$SD$ = screwdown position
$R_O$ = unloaded roll opening
$DR_S$ = approximate drive ratio of the screwdown mechanism which is predetermined and entered into data storage via the input terminal 36 or 37.
$M$ = gain factor which is initally established and entered into data storage via the input terminal 36 or 37. The gain factor (M) provides for compensating for the difference between the predetermined screwdown drive ratio ($DR_S$) and the actual screwdown drive ratio during mill operating conditions.

The unloaded roll gap $R_O$ is preferably initially determined and then set (by the mill operator or mill computer 26 for a particular workpiece pass,) using equations (3) and (4) above. The rolling mill is then operated with the mill operating controls 44 and during the following workpiece rolling operation the mill stand screwdown is precisely adjusted with the automatic gauge control system to regulate the workpiece output thickness by satisfying the following equation based on the combination of equations (3) and (4) above:

$$\Delta SD = \Delta G_O (DR_S \cdot M) - \Delta f(G_O/G_{CI}) \cdot \frac{A \cdot DR_S \cdot M}{K_{Mill}} \quad (5)$$

Where:

$\Delta SD$ = screwdown adjustment $\Delta G_O$ = the gauge error or difference between the actual workpiece output gauge or thickness ($G_O$) measured by the exit gauge 18 and the desired or nominal output gauge or thickness ($G_{NO}$).

$\Delta f(G_O/G_I)$ = difference between the material deformation coefficient ($C_{MD}$) at the measured or actual output gauge or thickness ($G_O$) and the desired or nominal output gauge ($G_{NO}$) using a calculated or simulated input gauge ($G_{CI}$) as hereinafter described in place of the actual input gauge or thickness ($G_I$).

The screwdown adjustment (ΔSD) is determined by the programmed digital computer 26 using the screwdown adjustment model set forth in equation (5) and the screwdown adjustment (ΔSD) is then suitably transmitted to the screwdown input logic circuit 32 for making the desired screwdown adjustment with the mill stand screwdown motors 40 (only one being shown but two screwdown motors, hydraulic or electrical, being typically provided). Also, a suitable crown control (not shown) may be provided in the screwdown system for separate adjustment of the screwdown motors. Where the screwdown system 30 employs a screwdown adjustment loop with an add/substract reference counter (not shown) as in the aforementioned U.S. Pat. No. 3,974,672, a series of increment adjustment pulses (each representing for example 0.000050 inch adjustment of the screwdown motors 40) are transmitted to the screwdown system 30 for use in establishing the desired screwdown adjustment. Also, a suitable manual and/or secondary automatic screwdown control 42 is preferably provided for backup and manual override operation of the screwdown system 30 and in performing preselected mill stand adjustment functions.

The digital computer 26 is perferably provided by a suitable large capacity microprocessor which has been appropriately programmed for calculating the screwdown adjustment as described herein.

The gauge control system provides for automatically continuously repeating the screwdown adjustment calculation with a predetermined delay interval between such calculation cycles established to be at least equal to the transport delay for effecting any screwdown adjustment and for the workpiece to travel from the mill stand 12 to the delivery gauge 18. Thus, the established delay interval may be a predetermined fixed time interval greater than the transport delay or may have a fixed relationship to the actual transport delay (the transport delay being determined with the tachometer 34 on the exit side of the mill stand 12). In any event, the automatic screwdown adjustment calculation cycles of the computer 26 are spaced so that each succeeding calculation is based on an output gauge reading ($G_O$) of the exit gauge 18 reflecting any screwdown adjustment resulting from the immediately preceding calculation cycle.

The computer 26 also continuously performs adaptive calculation cycles for empirically adjusting or adapting the calculated or simulated input gauge ($G_{CI}$) in accordance with appropriate statistical analysis of an immediately preceding succession of a sample number of time spaced comparisons of measured output gauge ($G_O$) and the preset, expected, or nominal output gauge ($G_{NO}$). In that regard, the automatic gauge control system of the present invention operates on the theory that all workpiece output gauge or thickness errors, though potentially caused by one or more of a large number of measurable and theoretical rolling mill parameters, can be accurately and effectively compensated for through the use of a calculated or simulated workpiece input gauge or thickness ($G_{CI}$) which differs from the actual workpiece input gauge or thickness. Thus, in accordance with the present invention, not only is the workpiece input gauge or thickness not measured but a calculated or simulated input gauge or thickness ($G_{CI}$) is employed in the screwdown adjustment model in accordance with suitable statistical analysis of the workpiece rolling history.

More particularly the calculated or simulated input gauge ($G_{CI}$) is determined in accordance with the following equation:

$$G_{CI(n)} = G_{CI(n-1)} + (\Delta a_1 + a_2 \cdot \Delta S)\, G_{NI} \qquad (6)$$

Where:

$G_{NI}$ = nominal input gauge of the workpiece.

$G_{CI(n)}$ = the calculated input gauge currently being determined.

$G_{CI(n-1)}$ = the calculated input gauge determined by the last adaptive calculation cycle.

$\Delta a_1$ = change in an offset or steady state correction coefficient ($a_1$) since the last $G_{CI}$ determination $a_2$ = drift rate correction coefficient ($a_2$) including any adjustment since the last $G_{CI}$ determination.

$\Delta S$ = linear travel (S) of the workpiece with respect to the delivery gauge 18 since the last $G_{CI}$ determination.

The offset or steady state correction coefficient ($a_1$) and drift rate correction coefficient ($a_2$) are employed for compensating for relatively long-term variations in rolling mill performance affecting workpiece output gauge or thickness. Although, with the automatic gauge control system of the present invention, the parameters affecting workpiece output gauge do not have to be specifically identified, the long-term parameters include for example (*a*) long-term change in the hardness of the metal strip workpiece, (*b*) heating of the mill stand rolls and housing, (*c*) long-term workpiece input thickness drift, and (*d*) heating and wear of the gauges 18. Numerous other relatively long-term parameters, both measurable and theoretical, are identified in the state of the art as affecting the rolled output thickness of the workpiece, and in effect all of such measurable and theoretical parameters are automatically compensated for with the automatic gauge control system. The automatic gauge control system, through statistical analysis of the output gauge readings, will adjust the offset coefficient ($a_1$) in the software mill model when a steady state workpiece output thickness error is detected and will adjust the drift cancellation coefficient ($a_2$) in the software mill model as soon as the rate and direction of any workpiece output thickness drift have been established.

At the beginning of a rolling mill pass, the offset and drift coefficients ($a_1$ and $a_2$) are assigned pre-established values determined from prior mill rolling experience. Alternatively, where there is insignificant prior experience, the offset and drift coefficients are assigned values of, for example, $a_1 = 1$, and $a_2 = 0$ and whereby the calculated or simulated input gauge $G_{CI}$ is initially made equal to the nominal input gauge ($G_{NI}$). In either event, the initial offset and drift coefficients ($a_1$ and $a_2$) are inserted into storage for example by the pass card inserted into the card operated data input terminal 36.

Suitable statistical analysis is employed for revising the offset and drift coefficients during rolling mill operation based on measured workpiece output gauge or thickness errors ($\Delta G_O = G_O - G_{NO}$) and using, for example, a succession of approximately the last 35 spaced output gauge readings (for which purpose the last fifty gauge readings, for example, are retained in memory) as a statistical sample in determining any drift coefficient adjustment and approximately the last 15 output gauge readings as a sample in determining any offset coefficient adjustment. The output gauge readings stored in memory are spaced, for example, at twenty millisecond intervals (i.e., at intervals preferably less than the transport delay time) and with the total sampling period preferably substantially greater than the transport delay time.

Statistical analysis of the last output gauge readings is also employed for stabilizing the mill screwdown adjustment model (which in essence comprises equations (5) and (6) above; the established time intervals between screwdown adjustment calculation cycles, output gauge readings and adaptive calculation cycles; and the methods of statistical analysis employed in the stabilization and offset and drift coefficient adjustments). The stabilization adjustments (based, for example, on a sample of the last approximately forty output gauge readings) include adjustment of the (1) transport delay interval (i.e., the interval between screwdown adjustment calculation cycles); (2) numbers of sample output gauge readings used in determining adjustments to the offset and drift coefficients ($a_1$ and $a_2$); and (3) screwdown gain factor (M).

Considering each of the foregoing stabilization adjustments in turn, the interval between screwdown calculations is incrementally increased (up to a fixed predetermined maximum limit) when the statistical analysis of the output gauge readings evidences screwdown "hunting" (i.e., that the workpiece output quality is less than the workpiece input quality), and therefore that the established transport delay interval is too short. Such may be due, for example, to slower screwdown responsiveness and/or tachometer inaccuracy. If such screwdown "hunting" is not found with the statistical analysis, the transport delay will be incrementally reduced (down to a fixed predetermined minimum limit) to increase the responsiveness of the screwdown adjustment process.

The numbers of sample output gauge readings used for adjusting the offset and drift coefficients are increased (up to a fixed predetermined maximum limit) if the workpiece output quality is poor and the calculated input gauge ($G_{CI}$) is being adjusted in large steps or too frequently and at approximately the same frequency as changes in the workpiece output gauge. Such indicates that the calculated input gauge ($G_{CI}$) is being adjusted to reflect short-term effects, contrary to the purpose of the calculated input gauge ($G_{CI}$), and the numbers of samples used in statistically adjusting the offset and drift coefficients are therefore incrementally increased. In contrast, if the statistical analysis does not evidence that the calculated input gauge ($G_{CI}$) is being adjusted to reflect short-term effects, the sampling numbers will be incrementally decreased (down to a fixed predetermined minimum limit) to increase the responsiveness of the screwdown adjustment process.

Finally, the screwdown gain factor (M) is incrementally increased or decreased (within fixed predetermined limits) if the mill screwdown adjustments ($\Delta SD$) are found to be consistently too little or too large, such errors normally resulting from a difference between the actual adjustment ratio of the screwdown mechanism and the ratio ($DR_S$) used in the mill model. In that regard, the actual adjustment ratio of a Sendzimir mill is very difficult to accurately determine and it varies significantly with roll opening, roll size and other variations in mill stand geometry. Also, if large screwdown corrections produce relatively poor quality workpiece gauge and small screwdown corrections produce relatively high quality workpiece gauge, the screwdown gain factor (M) is incrementally reduced or increased as appropriate for properly adjusting the large screwdown corrections without substantially affecting the accuracy of the small corrections.

A suitable diagnostic logic circuit 46 is employed in combination with the computer 26 for cycling the computer through self-diagnostic routines between adaptive and screwdown calculation cycles of the computer to inspect the system and alert the system of any actual or impending fault conditions. The diagnostic routines will attempt to route around known system faults and will "gracefully degrade" the mill model dropping function after function, only when uncorrectable faults exist. The mill operator will be signaled when the system has found an uncorrectable fault and who can then return the mill to manual control. If the diagnostic routines detect a serious fault (which could cause strip breakage, etc.), the automatic gauge control system will be deactivated and the mill will automatically return to manual operator control.

The types of system faults which the diagnostic routines can detect and correct include poor quality gauge and tachometer input signals, loss of communication with operator push buttons or other control signals, failure in the program or data memory, etc. Most of those faults are uncovered by monitoring alternate input paths provided for critical external signals for differences in or "flickering" (overly rapid change) of values. Other input failures are uncovered by periodically checking the reasonableness of the input signals. For example, a sudden shift in output strip thickness of one-tenth inch or a mill screwdown direction signal which contradicts the input and output gauge settings would be picked up by the diagnostic routines as an error state. Memory failures in the computer 26 and data storage circuit 22 are detected by comparing certain widely separated locations in the memory which were preset to identical values and checking for a mismatch.

When any "soft" or non-fatal errors are detected, attempts are made to re-route input signals and operate in new memory locations. If an error cannot be corrected, the system will disable those portions of the control program affected by that error and "gracefully degrade" to a less sophisticated configuration. Whenever a "soft" error is detected, the operator is warned of the fault and he then can return the mill to manual control.

If there are any "soft" errors which cannot be corrected and if the gauge control system cannot fall back to a less sophisticated configuration, or if some "hard" or major system fault, like loss of screwdown control, loss of power, microcomputer failure, etc., occurs, the gauge control system will disable itself and return the mill to operator control and signal a major fault.

The operator can also manually override any computer control signals by using the normal controls at the main mill control desk, to which the control system gives priority over any signals generated by the microcomputer software.

Figure 3:
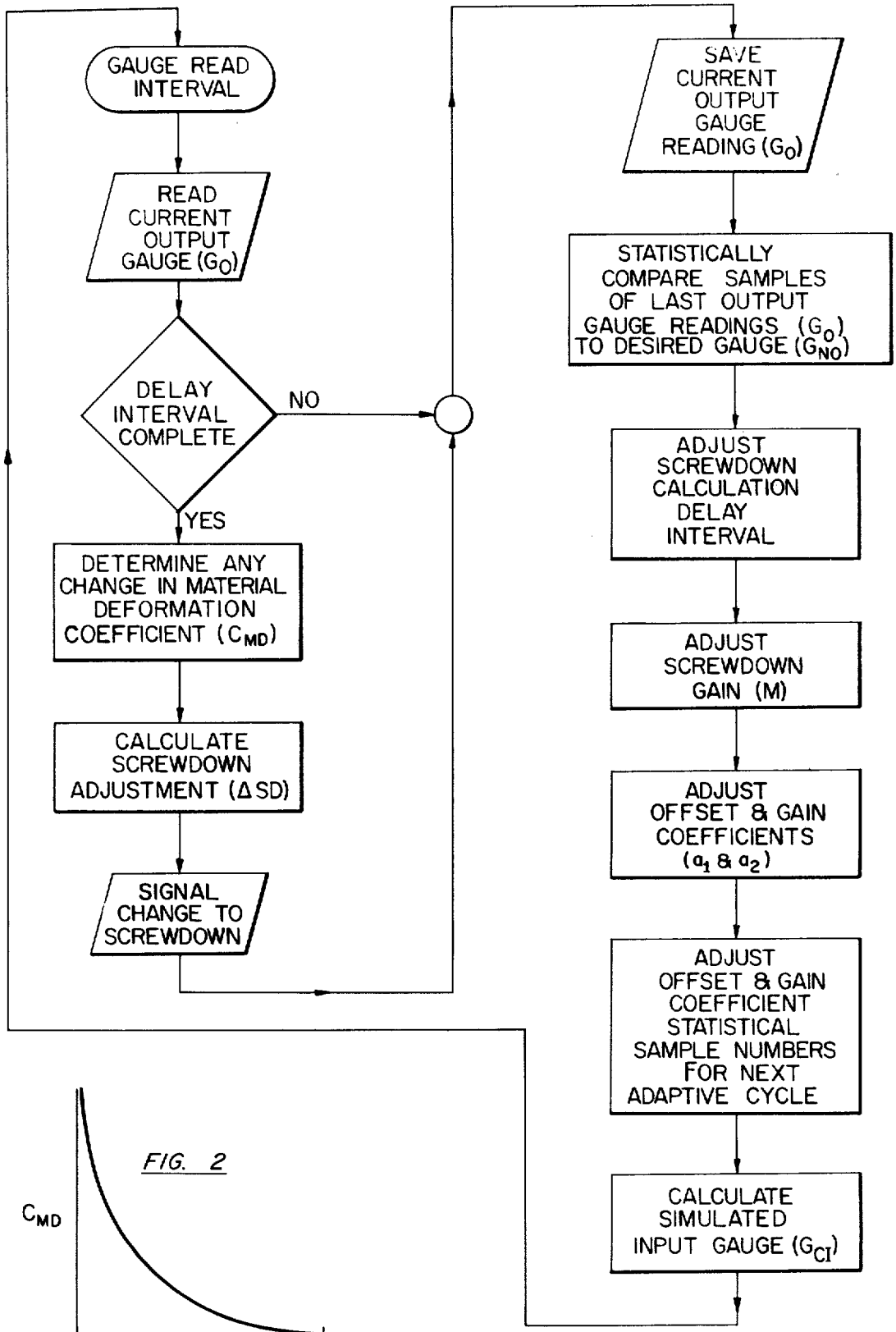
FIG. 3 is a block diagram of the guage control program employed in the gauge control system.

A block diagram of the gauge control program, excluding the diagnostic routines, is shown in FIG. 3. Briefly, the block entitled "Gauge Interval" represents the established interval (e.g., 20 milliseconds) between successive output gauge measurements ($G_O$) and such gauge measurements are represented by the next block entitled "Read Current Output Gauge ($G_O$)". The next block entitled "Delay Interval Complete" represents the step of determining if the required delay or transport interval between successive screwdown calculation cycles has elapsed. If the required delay interval has elapsed, a new screwdown calculation cycle is effected and at the end of the screwdown calculation cycle, a new adaptive calculation cycle is effected. If the required delay interval has not yet elapsed, a new adaptive calculation cycle is effected bypassing the screwdown calculation cycle.

During each screwdown calculation cycle, if either the calculated input gauge ($G_{CI}$) or screwdown gain (M) has been revised since the last screwdown calculation cycle, or the current output gauge reading ($G_O$) is different than the desired or nominal output gauge ($G_{NO}$), the material deformation coefficient ($C_{MD}$) and screwdown adjustment ($\Delta SD$) are then calculated as appropriate, and any calculated screwdown adjustment ($\Delta SD$) is then transmitted to the mill stand screwdown system 30 for adjustment of the loaded roll opening of the mill stand.

During each adaptive calculation cycle, the statistical analysis of the sample output gauge readings (using the current output gauge reading) is performed first and any adjustments, dictated by the statistical analysis, to the established transport delay interval, screwdown gain (M), offset and gain coefficients ($a_1$ & $a_2$), and the sampling numbers used for statistically determining any adjustment to the offset and gain coefficients ($a_1$ & $a_2$), are then determined in sequence. If revised, the simulated input gauge ($G_{CI}$) is then recalculated using the offset and gain coefficient adjustments and the linear travel ($\Delta S$) of the workpiece since the last ($G_{CI}$) determination.

Each revised or adjusted value is then used (until further revision during subsequent adaptive calculation cycle) in the screwdown calculation cycles in determining the material deformation coefficient ($C_{MD}$) and the screwdown adjustment ($\Delta SD$). After each adaptive calculation cycle is completed, there is a hold interval until the current gauge read interval is timed out, whereupon a new program cycle is initiated.

As will be apparent to persons skilled in the art, various modifications, adaptations and variations of the foregoing specific disclosure can be made without departing from the teachings of the present invention.

I claim:

1. A feed backward gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and to thereby adjust the roll opening and workpiece output gauge, means for measuring the output gauge ($G_O$) of the sheet metal workpiece; and computing means employing a predetermined mill screwdown adjustment model for determining any corrective screwdown adjustment for achieving a desired output gauge using rolling mill running variables consisting essentially of the measured output gauge ($G_O$) and an unmeasured simulated input gauge ($G_{CI}$), the screwdown adjustment means being connected to be operated by the computing means for adjusting the mill screwdown in accordance with said computed corrective screwdown adjustment, and the computing means being operable for adaptively adjusting said simulated input gauge ($G_{CI}$) based at least in part on a nominal input gauge ($G_{NI}$) of the workpiece and empirically on a plurality of spaced output gauge measurements.

2. A gauge control system according to claim 1 wherein the computing means is operable for adaptively adjusting said simulated output gauge from a statistical sampling of a plurality of spaced output gauge measurements.

3. A gauge control system according to claim 1 wherein the computing means is operable for separately computing any said corrective screwdown adjustment and adaptively adjusting said simulated input gauge ($G_{CI}$).

4. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and to thereby adjust the roll opening and workpiece output gauge, means for measuring the output gauge of the sheet metal workpiece; and computing means employing a predetermined mill screwdown adjustment model for determining any corrective screwdown adjustment for achieving a desired output gauge using rolling mill running variables, comprising measured output gauge ($G_O$) and a simulated input gauge ($G_{CI}$) based at least in part on the nominal input gauge ($G_{NI}$) of the workpiece and empirically on a plurality of spaced output gauge measurements.

5. A method of providing running output gauge control of a rolling mill having at least one mill stand with an adjustable screwdown for controlling the roll opening thereof through which a sheet metal workpiece is fed during a rolling mill run for reducing the thickness of the workpiece from an input gauge to an output gauge, comprising the steps of measuring the output gauge of the sheet metal strip, using computing means for determining any corrective screwdown adjustment for achieving a desired output gauge, employing a predetermined mill screwdown adjustment model using rolling mill running variables comprising measured output gauge ($G_O$) and a simulated input gauge ($G_{CI}$) of the workpiece, adjusting the mill stand screwdown in accordance with any said corrective screwdown adjustment determined by the computing means, and adaptively adjusting said simulated input gauge ($G_{CI}$) of the workpiece.

6. A method of providing running output gauge control of a rolling mill in accordance with claim 5, wherein the computing means determines any corrective screwdown adjustment ($\Delta SD$) based on the equation $\Delta SD = \Delta G_O \cdot K_1 - \Delta f(G_O/G_{CI}) \cdot K_2$ where $\Delta G_O$ equals the difference between a desired and said measured output gauge; $\Delta f(G_O/G_{CI})$ is the difference in a predetermined deformation coefficient ($C_{MD}$) function due to the difference in ratios of the measured output gauge and said desired output gauge respectively to said simulated input gauge ($G_{CI}$); and $K_1$ and $K_2$ are predetermined system constants with $K_2$ including the mill stand spring constant.

7. A method of providing running output gauge control of a rolling mill in accordance with claim 5, wherein the computing means adaptively adjusts said simulated input gauge ($G_{CI}$) based on the equation $$G_{CI} = (a_1 + a_2 \cdot S)\, G_{NI}$$

where ($G_{NI}$) equals the nominal input gauge, ($a_1$) and ($a_2$) are offset and drift coefficients respectively empirically adjusted through evaluation of a plurality of spaced output gauge measurements, and ($S$) is the workpiece travel distance.

8. A method of providing running output gauge control of a rolling mill in accordance with claim 7, wherein the offset and drift coefficients ($a_1$ & $a_2$) are empirically adjusted through evaluation of predetermined numbers respectively of the last successive output gauge measurements, and wherein the method further comprises the step of adaptively adjusting said predetermined numbers.

9. A method of providing running output gauge control of a rolling mill in accordance with claim 5, wherein the computing means separately determines said corrective screwdown adjustment and adjusts said simulated input gauge ($G_{CI}$) of the workpiece.

10. A method of providing running output gauge control of a rolling mill in accordance with claim 5, wherein the step of determining any corrective screwdown adjustment with the computing means is repeated every predetermined screwdown calculation interval related to the transport delay of the rolling mill, and wherein the method further comprises the step of adaptively adjusting said screwdown calculation interval through evaluation of a plurality of spaced output gauge measurements.

11. A method of providing running output gauge control of a rolling mill in accordance with claim 5, wherein the mill stand screwdown adjustment step is made in accordance with said determined corrective screwdown adjustment and a gain factor (M), and wherein the method further comprises the step of adaptively adjusting the gain factor (M) through evaluation of a plurality of spaced output gauge measurements.

12. A method of providing running output gauge control of a rolling mill in accordance with claim 5, wherein the computing means adaptively adjusts said simulated input gauge ($G_{CI}$) through evaluation of a plurality of spaced output gauge measurements.

13. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and to thereby adjust the roll opening and workpiece output gauge, means for measuring the output gauge of the sheet metal workpiece; and computing means employing a predetermined mill screwdown adjustment model for determining any corrective screwdown adjustment for achieving a desired output gauge using rolling mill running variables consisting essentially of the measured output gauge and a simulated input gauge ($G_{CI}$), the screwdown adjustment means being connected to be operated by the computing means for adjusting the mill screwdown in accordance with said computed corrective screwdown adjustment, and the computing means being operable for adaptively adjusting said simulated input gauge, the computing means computing the quantity $\Delta G_{O} \cdot K_1 - \Delta f(G_O/G_{CI}) \cdot K_2$ to determine any said corrective screwdown adjustment, where $\Delta G_O$ is any difference between the desired and measured output gauge; $\Delta f\,(G_O/G_{CI})$ is any difference in a predetermined strip material deformation coefficient function using the ratios of the measured output gauge and said desired output gauge respectively to said simulated input gauge ($G_{CI}$); and $K_1$ and $K_2$ are predetermined system constants with $K_2$ including the mill stand spring constant.

14. A gauge control system for a rolling mill having at least one mill stand with an adjustable screwdown for controlling the roll opening thereof through which a sheet metal workpiece is fed during a rolling mill run for reducing the thickness of the workpiece from an input gauge to an output gauge, screwdown adjustment means for adjusting the mill stand screwdown and to thereby adjust the roll opening and workpiece output gauge, means for measuring the output gauge of the sheet metal workpiece; and computing means employing a predetermined mill screwdown adjustment model for determining any corrective screwdown adjustment for achieving a desired output gauge using rolling mill running variables consisting essentially of the measured output gauge and a simulated input gauge ($G_{CI}$), the screwdown adjustment means being connected to be operated by the computing means for adjusting the mill screwdown in accordance with said computed corrective screwdown adjustment, and the computing means being operable for adaptively adjusting said simulated input gauge, the computing means being operable for adaptively adjusting said simulated input gauge ($G_{CI}$) based on the relationship $$G_{CI} = (a_1 + a_2 \cdot S)\, G_{NI}$$

where ($G_{NI}$) is the nominal input gauge of the workpiece, ($a_1$) and ($a_2$) are offset and drift coefficients determined by statistical analysis of spaced output gauge measurements, and ($S$) is the linear travel of the workpiece relative to the output gauge measuring means.

* * * * *